US007388155B2

(12) United States Patent
Forbes

(10) Patent No.: US 7,388,155 B2
(45) Date of Patent: Jun. 17, 2008

(54) ELECTRICAL CABLE EMPLOYING RESISTANCE CONDUCTORS

(76) Inventor: Larry Robert Forbes, 1460 Clair St., Ontario, CA (US) 91762

( * ) Notice: Subject to any disclaimer, the term of this patent is extended or adjusted under 35 U.S.C. 154(b) by 0 days.

(21) Appl. No.: 11/731,850

(22) Filed: Apr. 2, 2007

(65) Prior Publication Data

US 2007/0284127 A1 Dec. 13, 2007

Related U.S. Application Data

(60) Provisional application No. 60/812,414, filed on Jun. 12, 2006.

(51) Int. Cl.
*H01B 7/08* (2006.01)

(52) U.S. Cl. ..... 174/117 FF

(58) Field of Classification Search ..... 174/117 F, 174/117 FF, 117 A, 125.1
See application file for complete search history.

(56) References Cited

U.S. PATENT DOCUMENTS

| | | | | |
|---|---|---|---|---|
| 2,200,776 | A * | 5/1940 | Hoover | 156/55 |
| 2,769,148 | A | 10/1956 | Clogston | |
| 2,769,150 | A | 10/1956 | Black et al. | |
| 3,573,676 | A | 4/1971 | Mayer | |
| 3,757,029 | A | 9/1973 | Marshall | |
| 4,442,315 | A * | 4/1984 | Segawa | 174/36 |
| 5,574,260 | A | 11/1996 | Broomall et al. | |

* cited by examiner

*Primary Examiner*—Chau N Nguyen
(74) *Attorney, Agent, or Firm*—Kirk A. Buhler; Buhler & Associates

(57) ABSTRACT

An electrical cable that minimizes frequency sensitive group delay for consumer products and industrial use. A method constructing an electrical cable that minimizes frequency sensitive group delay for consumer products and industrial use. The cables utilize flat conductor made from resistive conductors. In other embodiments the conductors use a combination of metals where each has a different resistive property.

8 Claims, 8 Drawing Sheets

ELECTRICAL CABLE EMPLOYING RESISTANCE CONDUCTORS

CROSS REFERENCE TO RELATED APPLICATION

This application claims the benefit of Provisional 60/812,414 filed Jun. 12, 2006 the entire contents of which is hereby expressly incorporated by reference herein.

FIELD OF THE INVENTION

This invention relates to electrical transmission cables, more particularly to the design of cables that are designed to minimize deleterious group delay time smearing of the signal that is induced by inductive reactance and skin effect as the signal is conducted through the cables.

BACKGROUND OF THE INVENTION

In the transmission of a signal with varying frequency, each frequency will travel through a cable at a different rate. For the cable used in audio products the frequency generally ranges from 20 Hz to 20 KHz. This represents a 1000:1 ratio of the frequency being conducted through a cable. For higher frequency signals such as used in RF feed lines the signal the frequency being conducted ranges as high as several hundred megahertz. Because of the variation of frequencies being transmitted the materials and construction of cables for each application would be different. For audio cables the frequency components of the signal are launched synchronized in time but they emerge with the low frequencies delayed more than the high frequencies, resulting in group delay time smear. The frequency group delay time smear must be minimized in order to maintain the integrity of the signal being passed from one device to another to reproduce the best quality audio sound, for example a high fidelity audio reproduction, and likewise in video signal reproduction or data transmission.

Cables used in the transmission of high fidelity signals are used to interconnect audio components as well as to connect audio amplifiers to loudspeakers. While interconnect cables and loudspeaker cables both transmit the audio frequency range of 20 Hz to 20 KHz, the construction of interconnect cables and loudspeaker cables is significantly different. As a simple example, the cables connecting audio components can be highly resistive, with the cables used between the amplifier and the speakers must be highly conductive. In a further example, the cable connecting audio components are generally short in length, while the cables connected from the amplifier to the speakers is frequently much longer in length. Prior art high fidelity music signal cables inherently corrupt to one degree or another, complex waveforms during their travel from source to load. The human ear is keenly sensitive to time smearing signals, which detract from the illusion of a live musical performance as appreciated by the listener.

Inductive Reactance

Inductive Reactance is found using the Kirchhoff's loop rule that dictates that the magnitude of the potential difference across the inductor must equal the electro motive force (emf) of the generator. Generally the maximum potential difference equals the maximum current times the inductive reactance. This relationship is described with the equation $X_L=\omega L$, where $X_L$ is the inductive reactance, $\omega$ is the angular frequency of alternating current and L is the inductance. The greater the inductive reactance the less the maximum current. A conductor with greater inductance provides more opposition to the flow of current through the conductor, which reduces the maximum flow if the alternating current in the circuit so the faster the change (higher frequency) the more the inductor opposes the frequency. Inductance can be affected by several factors. For example, the size of the wire where the larger the diameter of the wire, the larger the inductance. Moreover, the lower the electrical resistance of a conductor, hence with greater current-carrying ability, the greater the inductance.

Skin Effect

Skin effect occurs in conductive materials when AC is applied. Skin effect forces electrons to flow from a maximum occupation of one-half the conductor's diameter or thickness cross-section to an ever-diminishing fraction of that diameter or thickness as electrons migrate nearer to the surface of the conductor and increasing the resistance to the flow of current. Skin effect forces the lower frequencies of the signal to travel in a restricted manner and delay the transmission of those frequencies. Higher frequencies will separate and travel faster through the conductor and reach the load before the lower frequencies.

There are currently numerous electrical cables available that attempt to minimize deleterious frequency-sensitive group delay time-smear artifacts. Seen among these products is a preponderance of cables using, for example, highly conductive high purity silver or copper conductors, and embracing a multitude of geometric constructions designed to counteract or minimize inductive reactance. Cables are also fabricated using various types of shielding to minimize noise, and certain cables use passive network elements added to the cable in attempts to minimize frequency sensitive group delay time smear. It is important to note that skin depth in a highly resistive alloy, such as nichrome, is approximately thirty times deeper than the skin depth of highly conductive metals such as silver or copper.

Skin Effect in Resistive Materials

The current related art has focused on reducing the inductance of audio, video and data interconnect cables by using a variety of geometries, as well as highly conductive metals such as copper and silver in an attempt to minimize frequency sensitive group delay time smear. Such cables may still produce frequency delays up to tens of milliseconds that cause, in the case of audio reproduction, signals to separate into distinct sounds that when emitted from the loudspeaker are audible to the listener. Further disadvantageously, the ability of such cables to minimize frequency sensitive group delay time smear is dependent upon numerous external factors, such as spacing of the source and return wires, dielectric media, the type of and disposition of shielding, the braiding geometry and the gauge of the wire used in the cable. These factors increase the cost and complexity of the cables without significantly reducing group delay time smear.

Conductors that are made with different material exhibit different conductive, resistive and inductive characteristics. The resistance of conductors is shown as $\sigma$ and is described in ohms per meter Copper has a $\sigma$ of $58\times10^6$ mhos/m, Aluminum has a $\sigma$ of $37\times10^6$ mhos/m, silver has a $\sigma$ of $61\times10^6$ mhos/m, gold has a $\sigma$ of $45\times10^6$ mhos/m, Tin has a $\sigma$ of $7.5\times10^6$ mhos/m, Lead has a $\sigma$ of $4.1\times10^6$ mhos/m, Nickel with 18% silver has a $\sigma$ of $3.1\times10^6$ mhos/m, Nichrome has a $\sigma$ of $0.015\times10^6$ mhos/m, 304 stainless steel has a $\sigma$ of $4.2\times10^6$ mhos/m.

Resistive Swamping

Resistive swamping is a method to keep an electrical frequency response curve flat and prevent signal overcompensation across a narrow range of frequencies. The use of resistive swamping circuit to overcome inductive reactance is widely used in electrical circuit design, by paralleling an inductor, i.e. bridging, with a resistor. Heretofore the use of an inherently resistive conductor to nullify the selfsame conductors' inductive reactance to the same effect has not been employed in signal transmission cables. The swamping of inductance by the implementation of resistance conductors forces the cable to assume a posture of a fundamental resistance potential divider, where electrical resistance overcomes inductance, and is therefore free of group delay time-smear otherwise caused by inductive reactance. When a cable comprised of resistance conductors is employed, for example, in an audio interconnect circuit, the resistance of the cable will reduce the audio gain level by a minimally small amount. With the addition of a minimal amount of audio gain by slightly turning up the gain of the volume control, the signal gain level will be restored to the gain level of a typical prior art cable that are typically comprised of highly conductive metals such as copper or silver. However, with the present novel new cable, the group delay time smear caused by inductive reactance will now be suppressed beneath the normal noise floor of the audio signal. Hence the group delay time smear associated with inductive reactance will now be removed from the audible signal, or, put another way, the deleterious group delay time smear will now be left well below the audible signal.

Capacitive Reactance

Capacitive reactance is the opposition to the passage of alternating (AC) current in electrical components or wires that is caused by the capacitance coupling that exists between to conductors that are carrying opposing or different signals. The relationship is described with the equation $X_c=1/(2\pi fc)$, where f is the AC frequency in hertz and c is the capacitance in farads. The reactance $X_c$ is large at low frequencies and small at high frequencies. For steady direct current (DC) the capacitive reactance is infinite.

Proximity Effect

The Proximity Effect explains the effect of two conductors running adjacent to each other where the signal from one conductor affects the signal in the other conductor based upon the proximity of one conductor to another conductor, or a group of conductors. The proximity effect is also called current-bunching, in that a predominance of current in adjacent conductors is greatest, that is, bunches, in the cross-sectional area of the conductors where the forward signal-carrying conductor and the return signal-carrying conductor are in closest proximity to one another. If it is desirous to force audio or video currents to travel within a preferred domain within the body of a conductor, the phenomenon may be accomplished by disposing the preferred domain of the metallic conductors in close proximity to one another and therefore take advantage of the proximity effect. Due to the proximity effect, audio signals that exist in the cable that pass closest to each other in parallel audio signal cable, i.e. the higher frequencies, will be affected the greatest, dependent upon frequency, and in keeping with the dictates of the skin effect, while signals less affected by skin effect, i.e. the lower frequencies, that exist in the core and/or the sides of the conductors opposite the proximate sides of the conductor, will be less affected by the proximity effect. The optimum implementation of the proximity effect is seen in the present invention in the employment of ribbon conductors. Contiguously disposed ribbon conductors will benefit from both the skin effect, and the proximity effect, in embodiments where the predominant currents will flow on or near the surfaces of the facing sides of the ribbons so contiguously disposed.

The best threshold of the audibility of frequency group time delay have been provided by Blauert, J. and Laws, P "Group Delay Distortions in Electroacoustical Systems", Journal of the Acoustical Society of America, Volume 63, Number 5, pp. 1478-1483 (May 1978) and are shown in the table below.

| Frequency | Threshold | Period | Cycles |
|---|---|---|---|
| 8 kHz | 2 ms | 0.125 ms | 16 |
| 4 kHz | 1.5 ms | 0.25 ms | 6 |
| 2 kHz | 1 ms | 0.5 ms | 2 |
| 1 kHz | 2 ms | 1 ms | 2 |
| 500 Hz | 3.2 ms | 2 ms | 1.6 |

The Group Delay is equal to $-(\Delta\phi)/(\Delta\omega)$ where $\phi$ is the phase angle and $\omega$ is the frequency. Exceeding these values degrades and distorts the transmitted analog or digital signals producing data error or audible miscues. The period of a 2 KHz signal is 0.5 ms and therefore a 2 KHz signal being delayed 1 ms would be delayed two complete cycles.

Presently available cables designed to connect audio, video and data devices together inherently corrupt the complex analog waveforms or the bit stream during the signal's travel from source to load causing distorted analog signals and potential detrimental reduction of data bit rates because of inductive reactance and/or the skin effect. Both inductive reactance and skin effect impose the group time delay effect upon signals in a frequency-dependent manner.

Therefore there exists a need for an electrical cable that minimizes frequency-sensitive group time delay in audio, video and data communications interconnect cables that does not embrace these disadvantageous properties.

BRIEF SUMMARY OF THE INVENTION

It is an object of the electrical cable to provide a cable that induces the DC-resistance swamping effect to overcome deleterious inductive reactance not employed in prior art cables presently available today.

It is an object of the electrical cable to provide a relatively high resistance cable that is uniquely designed as an interconnect cable between audio, video and data equipment that eliminates or significantly reduces time smearing that presently exists with prior art cables.

It is another object electrical cable to provide a simultaneous high resistance and low resistance cable uniquely designed as a connecting cable between an amplifier and speakers that eliminates or significantly reduces time-smearing that exist with prior art cables. This is accomplished through the employment of a hybrid of low-resistance and high-resistance conductors that in sum ensure a coherent passage of all audio signals from source to load with a pronounced reduction of otherwise audible group delay time smear anomalies in the signal emitted from the speakers.

It is another object electrical cable to provide an electrical cable that minimizes frequency sensitive group delay time smear in audio, video and data cables employed in audio, video and data signal transmission applications.

It is an object of the electrical cable to provide a method for constructing a cable that minimizes frequency sensitive group delay time smear in audio, video and data cables employed in audio, video and data transmission applications.

It is an object of the electrical cable to provide a cable that is constructed with a plethora of metals with different electrical conductivities and skin effect characteristics to eliminate or significantly reduce time smearing that exists with prior art audio, video and data transmission cables, but primarily and necessarily employed in loudspeaker cables. Such a hybrid combination of low resistance conductors mingled with high resistance conductors provides a high-resistance pathway for high frequencies where the skin effect predominates, and a low resistance pathway for lower frequencies. Such a hybrid cable ensures ample current transfer from amplifier to loudspeaker and, further, preserves the amplifier's necessary damping factor ability to control the movement of loudspeaker transducers.

It is an object of the electrical cable to provide a cable that is constructed of a twisted pair of conductors where the twisting of the conductors cancels out anomalous signals and reduces time smearing caused by the conduction of different frequencies.

It is the object of the electrical cable that is constructed within multiple isolation channels where the coupling of the signal between adjacent conductors is reduced and the skin effect is reduced with the use of flat conductors.

It is the further object of an electrical cable to provide ample electrical current path of lower frequencies where the skin effect does not predominate. This provides a passage of all audio signals from the source to the loudspeaker load with a reduction in time smearing anomalies in the higher-frequency signals while retaining the necessary low-impedance current-carrying feature necessary for the adequate transfer of electrical current to the loudspeaker load.

It is another object electrical cable to provide a cabling with improved separation of the conductors with separation by an insulating film of high dielectric strength such as PTFE or polyimide.

It is an object of the electrical cable to provide improved termination connections from the conductors to the connectors, using connectors such as spade lugs or RCA jacks, or typical standardized data communication connectors, to minimize damage or harm to the electrical connection without impeding the audio, video or data signal being passed through the cable.

It is another object of the electrical cable to take advantage of the inherent shielding nature of the resistance signal conductor ribbon or wire. When small ambient electromagnetic or radio frequency fields impinge upon the ribbon or wire conductors the electrical resistance of said conductors will absorb and dissipate in the form of heat the small ambient electromagnetic or radio frequency energy created by said field as it travels through the resistance conductor, and said energy will be essentially reduced to zero at the RCA plug, spade lug or other termination. The resistance conductor can therefore be seen to act concomitantly as both a signal conductor and electromagnetic and radio frequency shield and thus obviate incorporation of a separate electrical shield as is seen in many prior art audio, video and data transmission cables. In special applications where the cable is situated in close proximity to generators of intense electromagnetic or radio frequency fields, a separate shield of conductive material may under this circumstance be incorporated into the ground return portion of the cable circuit by virtue of a conventional coaxial cable embodiment.

It is still another object of the electrical cable to provide a cable with mechanical dampening characteristics with the incorporation of dead-soft metals such as copper, aluminum or silver to reduce or eliminate the conduction and transmission of mechanical vibration along the electrical conductor.

It is a further object of the electrical cable to provide a cable with mechanical dampening characteristics with the incorporation of thin film polymers such as acrylic resin infused with finely-divided particles of silver or copper or aluminum to reduce or eliminate the conduction and transmission of mechanical vibration along the electrical conductor.

The present invention transmits all signals from low frequencies to high frequencies through the cable with little frequency sensitive group delay. The swamping of inductance by the implementation of resistance conductor yields a cable essentially free of inductance, and is therefore free of group-delay time-smear otherwise deleteriously caused by inductive reactance.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
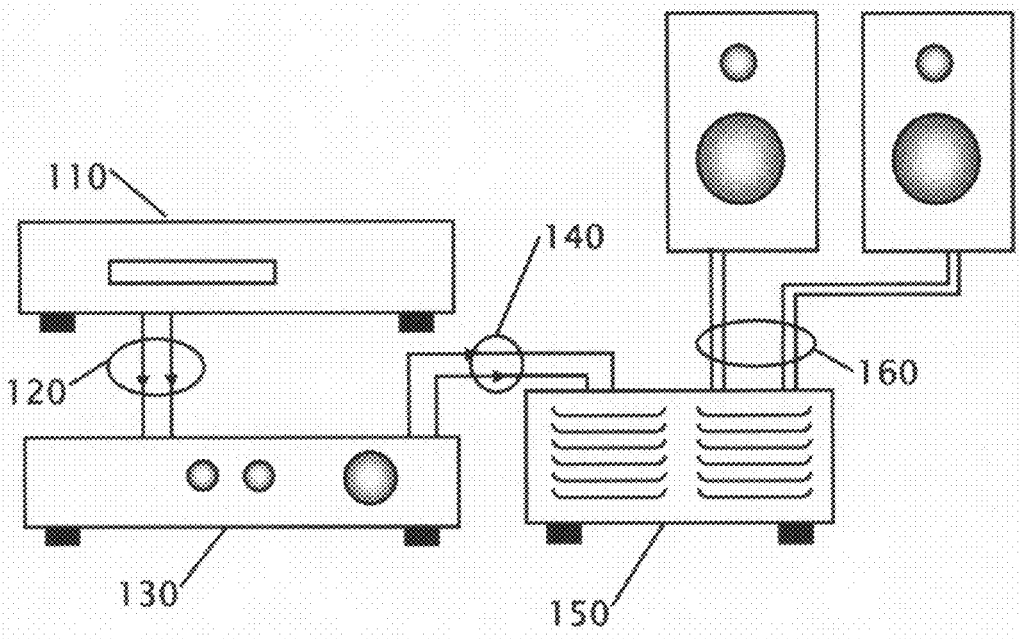
FIG. 1 is a typical connection configuration for a high fidelity audio system.

All dimensions specified in this disclosure are by way of example only and are not intended to be limiting. Further, the proportions shown in the FIG. are not necessarily to scale. As will be understood by those with skill in the art with reference to this disclosure, the actual dimensions of any device or part of a device disclosed in this disclosure will be determined by its intended use.

As used in this disclosure, except where the context requires otherwise, the term "comprise" and variations of the term, such as "comprising", "comprises" and "comprised" are not intended to exclude other additives, components, integers or steps.

The term "litz wire" is derived from the German word "litzendraht" meaning woven wire and is constructed of individually insulated magnet wires either twisted or braided into a uniform pattern. Litz wire sizes are expressed as N/XX, where N=the number of strands and XX=the American Wire Gauge (AWG) size of each strand. For example a typical size of litz wire is expressed as: "20/30" or 20 strands of 30 AWG.

The term "nichrome" means an alloy typically comprising 80% nickel and 20% chromium comprising a melting point of about 2550° F. and is commonly used in electric resistance heating elements in the form of wire and strip.

The term "group delay" means that an alternating current electrical signal at some frequencies take longer to travel through a cable, circuit, amplifier or network than alternating current electrical signals at other frequencies.

The term "time smearing" means a form of group delay due to energy storage in various circuits and circuit parts where all the frequency components of a signal are initially transmitted synchronized in time but emerge after traversing a cable with the lower frequencies delayed more than the higher frequencies.

The term "skin effect" means the tendency of alternating current (AC) to flow near the surface of a conductor, thereby restricting the current to a small part of the total cross-sectional area and increasing the resistance to the flow of current. Note: skin effect is caused by the self-inductance of the conductor, which causes an increase in the inductive reactance at high frequencies, thus forcing electrons toward the surface of the conductor.

The term "skin depth" means the distance below the surface where the current density has fallen to 1/e or 37% of its value at the surface and is inversely proportional to the square root of frequency. The formula for skin depth is:

$$\sigma=2.6*K1/\sqrt{f}$$

σ is the skin depth in inches f is in Hertz

K1 is a function of the material, $K1=\sqrt{[1(1/u_r)*rho/rhs_{copper})]}$

The ratio of $rho/rhs_{copper}$ is the relative bulk resistivity of the material, as referenced to that of copper where copper is set as the standard of 1 i.e. K1=1 for copper.

| Material | rho | rho_rel | K1 |
|---|---|---|---|
| Silver | 1.59 | 0.90 | 0.94 |
| Copper | 1.77 | 1.000 | 1.000 |
| Aluminum | 2.69 | 1.51 | 1.23 |
| Tungsten | 5.5 | 3.11 | 1.76 |
| Brass | ~7.0 | 3.95 | 1.99 (alloy dependent) |
| Phos-bronze | 7.8 | 4.4 | 2.1 |
| Tin | 11.5 | 6.49 | 2.55 |
| Bronze | 17. | 9.6 | 3.1 |
| Lead | 22. | 12.4 | 3.52 |
| 304 Stainless | 73 | 56.5 | 41.2 |
| Nichrome | 110. | 87.1 | 65.3 |

The term "inductive reactance" means a restriction in the flow of current through a circuit or electrical wire, similar to resistance, expressed in ohms and is calculated as follows:

$$XL=2*pi*f*L$$

XL is the inductive reactance measured in ohms; X is the electrical symbol for "reactance"

L is the symbol for "inductance" or "inductor", in henries (the standard unit of inductance)

pi is the ratio of a circle's circumference to its diameter, to wit: 3.1416, etc f is the frequency of the current flowing through the circuit.

The term "swamping" means a method to keep an electrical frequency response curve flat and prevent signal overcompensation at a narrow range of frequencies.

The term "interconnect" refers to a conductor that connects line-level signals in an audio, video or data communication system. For example, interconnects are used between source components (CD player, turntable, tape deck tuner) and the preamplifier, and between the preamplifier and the power amplifier of a typical audio system. For purposes of this specification, the terms "cable," "wire," "electrical wire" and "interconnect" are used interchangeably.

The term "current bunching" describes electrical current migration toward its opposite sign causing a concentration of current in the cross-sectional area of appositional conductors at the most proximal point.

The predominant factor regarding the interaction of signals with varying frequencies is found in Maxwell's equation where parallel wires carrying electrical currents in the same direction attract each other magnetically. The attraction force is calculated in newtons per unit length in the equation.

$F=2.(m_0/4\,p).I_1I_2/r$ or as $F=2.10^{-7}.I_1I_2/r$ since the magnetic force of $2.10^{-7}$ newtons of force is exerted on parallel wires placed one meter apart carrying the same current.

The total flux of electrical field out of a closed surface is the total enclosed charge multiplied by $1/\square_0$, which produced Maxwell's first equation:

$$\int E.dA=q/\epsilon_0$$

Maxwell's third equation deals with the electrostatic case where the path integral of ∫E.ds=0 for electrostatics the full version of Maxwell's third equation is:

$$\int E.ds=-d/dt(\int B.dA)$$

Where the area integrated over the right hand side spans the path on the left hand side.

Capacitive coupling exists across two conductors when there is a changing electric field. The capacitive coupling is not affected by the frequency of the change in the conductors. The amount of coupling is a function of the proximity of the conductors to one another as well as the effective surface area of the conductors. The total electric flux across the surface between the conductors is shown with the equation:

$$\int E.dA=1/\epsilon_0.q$$

The present invention overcomes disadvantages inherent in the current art by suppressing both inductive reactance and skin effect. This is accomplished by selecting a conductor with an inherently high DC resistance, with said resistance swamping said inductive reactance. The skin effect is suppressed and a high electrical conductivity is restored to the cable by using a plurality of individually-insulated wires within the body of the cable. Although the use of resistive swamping circuit to overcome inductive reactance is widely used in electrical circuit design, by paralleling an inductor with a resistor, i.e. bridging, the use of an inherently resistive conductor to yield the same affect has not heretofore been considered in signal transmission cables.

The present invention uses wires, litz wires, ribbons or wire mesh of relatively high direct current (DC) resistance, typically nichrome, stainless steel, or other high resistant material to intrinsically bridge the conductors' inductance and therefore swamp the inductance. The calculated skin depth in a highly-resistive alloy, such as nichrome, is many times deeper than the skin depth of highly conductive metals such as silver or copper. Since the AC skin effect phenomenon forces electron flow from a maximum occupation of one-half the conductor's diameter or cross-section to an ever-diminishing fraction of that diameter as electrons migrate nearer to the surface of the conductor, it may be readily seen that at a given higher frequency, an AC signal will commence a race ever nearer to the surface of a highly-conductive material such as copper or silver at a frequency far lower than the same signal passing through a highly resistive alloy such as nichrome or stainless steel. The point at which skin depth commences to attenuate higher-frequency signals due to skin effect diminution of electron flow, will be shifted to a frequency above 20 KHz through the use of a highly-resistive resistive metal or metallic alloy such as nichrome or stainless steel. Hence the resulting frequency-dependent group time delay is nullified. Moreover the skin effect that in prior art cables comprised of copper, silver or other highly conductive metals increases group delay in audio frequencies in the 5 KHz to 20 KHz region, it remains flat across the audio band in the nichrome, stainless steel or other resistive metal conductors.

The present invention transmits all signals from low frequencies to high frequencies pass through the cable with little frequency sensitive group delay. The swamping, or nullification, of inductance by the implementation of resistance wire forces the cable to assume a posture of a distributed resistance conductor, essentially free of inductance, and therefore free of group delay time smear otherwise effected by inductive reactance.

The present invention also addresses the issue of skin depth. The skin depth of nichrome and other resistance wires is many times the skin depth of copper or silver. The use of fine-gauge nichrome or other resistance wire, or ribbons, passes the highest audio frequencies without the attenuation observed with copper, silver or other highly-conductive wire, by placing the critical skin depth above the range of the highest audio frequencies. When a current passes through a conductor, such as nichrome or stainless steel or other relatively highly-resistive metal, the current is forced to occupy the entire cross-sectional area of the nichrome conductor.

Referring now to FIG. 1, there is shown a typical connection configuration for a high fidelity audio system. A high fidelity audio system as shown in this FIG. includes a source that is played, and in this FIG. the source is a CD player 110. Other types of audio playing apparatus can be used including but not limited to a phonograph turntable and reel to reel tape players. The source is then connected to a pre-amplifier 120 with cables 130. The pre-amplifier is then connected to a power amplifier 140 with cables 150 that are similar or the same construction as cables 130. The power amplifier is then connected with wiring 160 to the speakers 170. While only two speakers each with a single woofer and a single tweeter are shown a plethora of speaker configurations are available and are connectable with the contemplated cable design 160.

The cables 130 and 150 are typically a high resistance cable that is uniquely designed as an interconnect cable between audio and or video products. The design and construction of these cables is shown and described in more detail with FIGS. 10 and 11. These interconnection cables connect a low impedance signal usually in the range of 80 to 100 Ω and the transmitted signal has low power (approximately some tens of milliwatt).

The cables 160 are constructed with different materials because the speakers have a typical impedance value in the range of 4-16 Ω. These cables require a low resistance cable uniquely designed as an interconnect cable between an amplifier and loudspeakers that eliminates or significantly reduces time-smearing that exist with prior art cables. This is accomplished with a hybrid of low and high conductivity conductors making a coherent passage of all audio signals from source to load with a pronounced reduction of otherwise audible group delay time smear anomalies in the signal when heard from the speakers. The speaker connecting cables are constructed with a plethora of metals with different electrical conductivities and skin effect characteristics to eliminate or significantly reduce time smearing that exist with prior art cables. Low resistance conductors coupled with high resistance conductors provides a high-resistance pathway for high frequencies, and a low resistance pathway for lower frequencies. The high-resistance portion of the cable is disposed in innermost apposition contiguity, with the low-resistance portion of the cable disposed in outermost appositional contiguity. This provides a passage of all audio signals from the source to the speaker load with a reduction in time smearing anomalies in the signal as it is reproduced from the speakers while preserving the cable's current-carrying ability and moreover preserving the amplifier damping factor as it is applied to the loudspeakers. The design of these speaker cables are shown and described in more detail in FIGS. 6-9.

Figure 2:
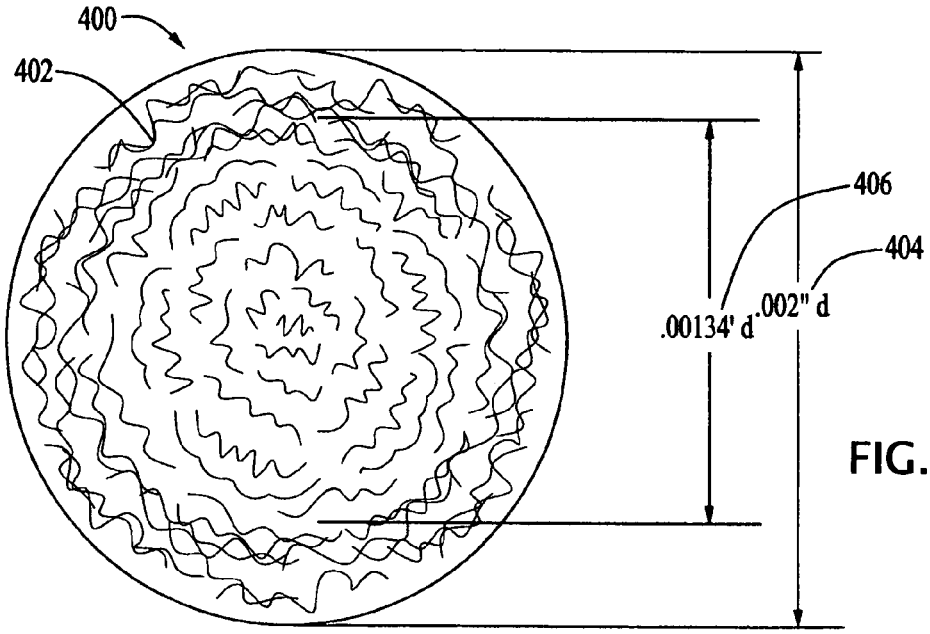
FIG. 2 is a cross-section view of the skin effect on a copper conductor at 10,000 Hz.

In FIG. 2 there is shown a cross-section view of an insulated cable 100 using round litz wires for minimizing frequency sensitive group delay for consumer products and industrial use according to one embodiment of the present invention. As can be seen the cable 100 comprises an outer insulating layer 102 that encloses a plurality of uniformly arranged, individually insulated 104 round wire strands 106. In one embodiment, the round wire strands 106 comprise a highly electrically-resistant conductor with a resistively of about between $90\times10^{-8}$ ohms and $560\times10^{-8}$ ohms at 20 degrees centigrade. In another embodiment, the highly electrically-resistant conductor is selected from the group consisting of nichrome, stainless steel, tungsten and platinum. In a preferred embodiment, the highly electrically-resistant conductor is nichrome.

Figure 3:
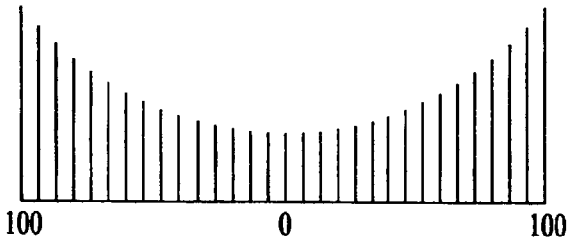
FIG. 3 is a bar chart showing the current flow of the copper conductor in FIG. 4.

Referring now to FIG. 3, there is shown a cross-section view of an insulated cable using rectangular non-insulated wires for minimizing frequency sensitive group delay for consumer products and industrial use according to one embodiment of the present invention. As can be seen the cable 200 comprises an outer insulating layer 202 that encloses a plurality of non-uniformly distributed, non-insulated rectangular wire strands 204. In one embodiment, the rectangular wire strands 204 comprise a highly electrically-resistant conductor with a resistivity of about between $90\times10^{-8}$ ohms and $560\times10^{-8}$ ohms at 20 degrees centigrade. In another embodiment, the highly electrically-resistant conductor is selected from the group consisting of nichrome, stainless steel, tungsten and platinum. In a preferred embodiment, the conductor is stainless steel.

Figure 4:
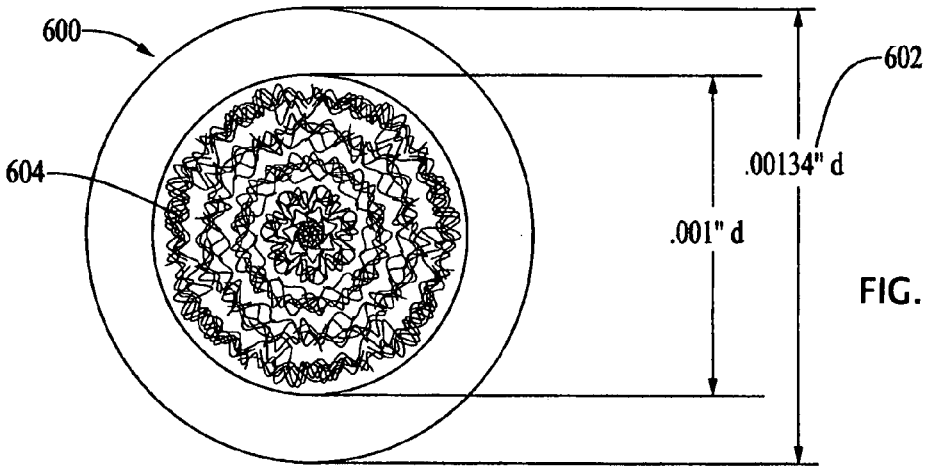
FIG. 4 is a cross-section view of the skin effect on a nichrome conductor at 10,000 Hz.

Referring now to FIG. 4, there is shown a cross-section view of an insulated cable using rectangular litz wires for minimizing frequency sensitive group delay for consumer products and industrial use according to one embodiment of the present invention. As can be seen the cable 300 comprises an outer insulating layer 302 that encloses a plurality of uniformly arranged, individually insulated 304 rectangular wire strands 306. In one embodiment, the rectangular wire strands 306 comprise a highly electrically-resistant conductor with a resistivity of about between $90\times10^{-8}$ ohms and $560\times10^{-8}$ ohms at 20 degrees centigrade. In another embodiment, the highly electrically-resistant conductor is selected from the group consisting of nichrome, stainless steel, tungsten and platinum. In a preferred embodiment, the highly electrically-resistant conductor is nichrome.

Figure 5:
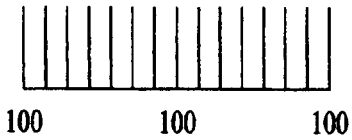
FIG. 5 is a bar chart showing current flow of the conductor in FIG. 6.

Referring now to FIG. 5, there is shown a cross-section view of the skin effect on a copper conductor at 10,000 Hz. As can be seen, the electron flow 402 has moved to the surface of the conductor 400. In this instance the majority of the signal is propagated at a skin depth of 0.00066 inches in of the conductor 400. This leaves the majority, 0.00134 inches in diameter, of the conductor transmitting a minimum of the frequency that the conductor theoretically is capable of transmitting.

Referring now to FIG. 3, there is shown a bar chart showing the current flow of the copper conductor in FIG. 2. As can be seen the utilization of the conductor drops significantly near the center of the conductor, indicated as zero (0) on the chart. While, the exterior portions of the conductor indicated as 100 on both ends of the chart, carry the majority of the signal. This results in part of the signal frequencies reaching the destination load ahead of the signal frequencies traveling on the surface of the conductor 400. Thus resulting in time smear due to skin effect.

Referring now to FIG. 4, there is shown a cross-section view of the skin effect on a nichrome conductor at 10,000 Hz. As can be seen, the smaller diameter 602 nichrome conductor 600 with a high electrical resistance creates a resistive swamping effect that channels the entire signal to the center 604 of the nichrome conductor 600. All the frequencies of the signal travel through the center of the conductor 600 and will reach the load at the same time.

Referring now to FIG. 5, there is shown a bar chart showing current flow of the conductor in FIG. 4. The nichrome conductor 600 (shown in FIG. 4), maintains a constant signal spread across the entire chart. All frequencies being transmitted through the nichrome conductor 600 arrive at the same time to the load with negligible frequency delay.

Figure 6:
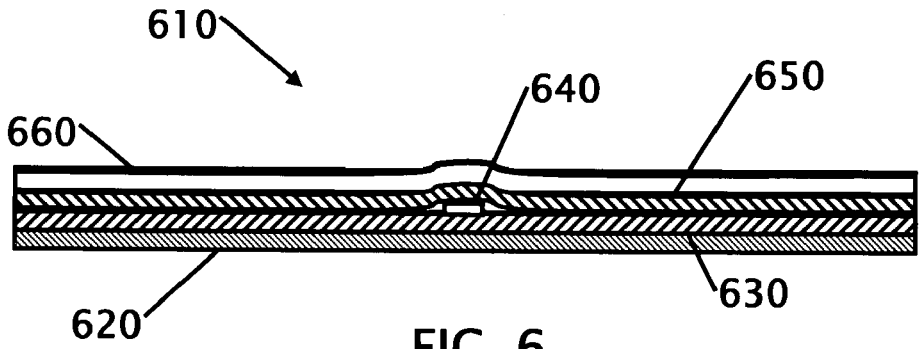
FIG. 6 is an end view of an insulated cable using sandwich construction according to one embodiment of the present invention.

Referring now to FIG. 6, there is shown an end view of an insulated cable using sandwich construction according to one embodiment of the present invention. This is a single conductor in a sandwich construction for minimizes frequency sensitive group delay for consumer products and industrial use according to one embodiment of the present invention. The conductor groups consist of sandwiched conductor where each as a different conductivity and corresponding skin effect. The contemplated conductor materials are from a group of materials including but not limited to nichrome, aluminum, copper, silver, gold, lead, zinc, carbon, copper-tungsten alloys, palladium, stainless steel, tungsten and platinum. As can be seen the cable 610 is formed from a first conductor 620 formed from a heavy metal such as lead. The lead provides a stable base that reduces transmission of mechanical vibration and or EMF forces along the conductor. The second conductor 630 is made from nichrome and provides a higher resistance conductor where the skin effect is significantly reduced due to the higher resistance value. The third conductor 640 is copper and ribbon or foil that provides conductive path so the overall resistance of the conductor does not exceed the system requirements. The fourth conductor 650 is a Nickel conductor. The variation of conductor materials each with different conductivity and skin effect allows the complex musical signal being passed through the conductor to arrive at the speaker at virtually the same point in time and in phase with each other. The top layer 660 is an insulator comprises a polytetrafluoroethylene (PTFE) film.

Figure 7:
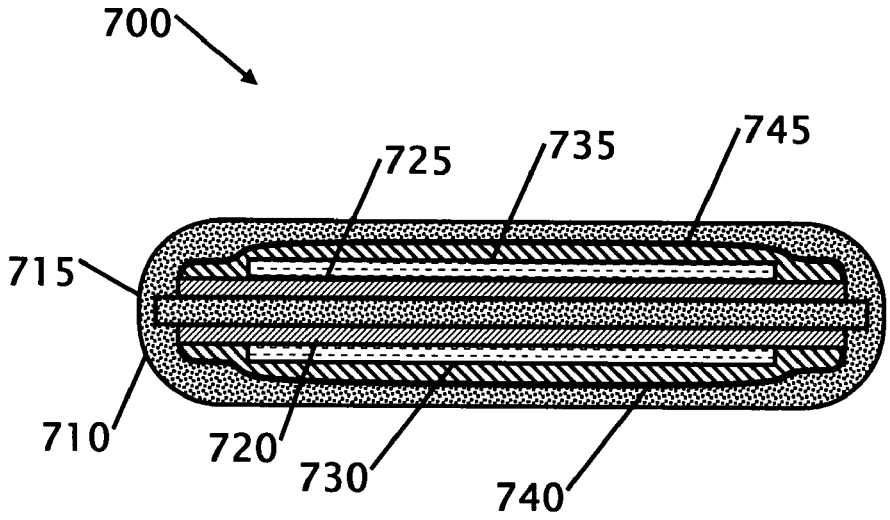
FIG. 7 is an end view of an insulated cable using sandwich construction according to a second preferred embodiment for a speaker conductor cable.

Referring now to FIG. 7, there is an end view of an insulated cable using sandwich construction according to a second preferred embodiment for a speaker conductor cable. As can be seen, the cable 700 is constructed of several layers. In one embodiment, the outer insulating layer 710 comprises a polytetrafluoroethylene (PTFE) film. In another embodiment, the outer insulating layer 710 comprises a polyimide film. The insulator 715 that exists in the middle of the sandwich provides electrical isolation and a dielectric between the conductors. The thickness of insulator 715 affects the capacitive coupling between the two conductor groups. In a preferred embodiment, the highly electrically-resistant conductive ribbon 720 and 725 is nichrome.

In one embodiment, the inner substrate 730 and 735 comprises of an electrically-resistive alloy foil, such as 304 grade stainless steel, may be bonded on either side of the central copper substrate. In a preferred embodiment, the copper (Cu) ribbon or foil is bonded to the nichrome outer layer. In one embodiment, the inner substrate 740 and 745 is a copper (CU) ribbon or foil surrounded by the insulator 715 made of polytetrafluoroethylene (PTFE) film or material with equivalent insulation and protective characteristics.

Figure 8:
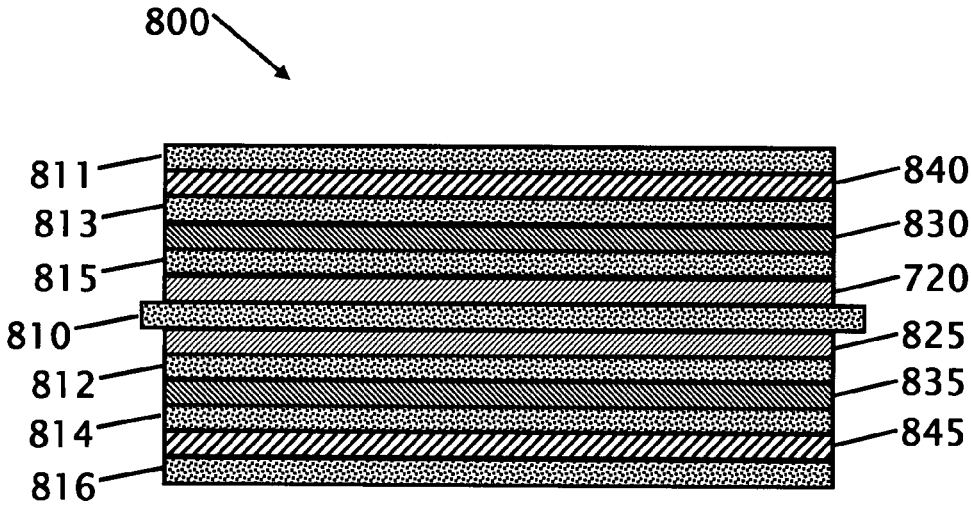
FIG. 8 is an alternative cross sectional view of a third preferred embodiment of a speaker conductor construction.

Referring now to FIG. 8 is an alternative cross sectional view of a third preferred embodiment of a speaker conductor construction. As can be seen, the cable 800 is constructed of several layers. In one embodiment, multiple insulators or dielectrics 810-816 isolate each conductor as they connect each side of the amplifier or speaker. In another embodiment, the film dielectric layers 1404, 1406 and 1410 comprise a polyimide film. The thickness of insulator affects the capacitive coupling between the two conductor groups. In one preferred embodiment the inner conductors 820 and 825 are highly electrically-resistant conductive ribbon of nichrome. The next set of conductors 830 and 835 are made from Tungsten, while the outer 840 and 845 conductors are made from Cu ribbon or foil. In another embodiment, the cable is constructed as a tri-laminate of copper, aluminum and nichrome. In another embodiment, the cable is constructed as a quad-laminate of copper, aluminum, nickel and nichrome. It is further contemplated that each conductor be constructed with a different width conductor where the width is optimized based upon the conductivity and or skin effect. The ends of the two ribbons are soldered together and attached to short braided silver "pigtails" terminated with spade lugs as shown and described in FIG. 9.

Figure 9:
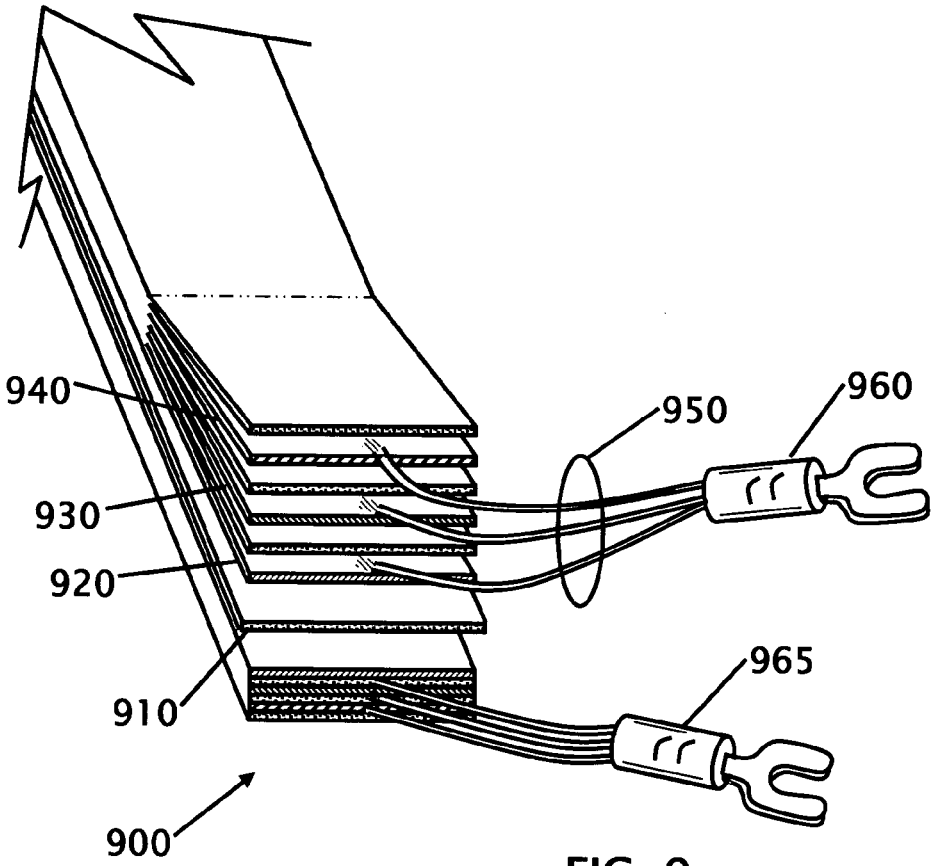
FIG. 9 is the preferred embodiment of a speaker wire construction from FIGS. 6-8 showing the termination of the conductor with spade lugs.

Referring now FIG. 9 that shows a preferred embodiment of a speaker wire construction from FIGS. 6-8 showing the termination of the conductor with spade lugs. The cable shown is with a tri metal laminate with an insulator 910 separating the two sets of conductors. The upper group of conductors is shown separating the lower group of conductors to show the attachment of the electrical connection. The insulators are spread from the conductors 920, 930 and 940. Wires 950 are individually attached to each of the conductors. The attachment method includes but is not limited to soldering, brazing, mechanical fasteners, clamps, welding or with conductive adhesives. The individual conductors are then collected and attached to a spade terminator 960. A separate terminator 965 provides contact with the second group of conductors. In another embodiment, the cable ends are terminated with a banana plug type connector.

Figure 10:
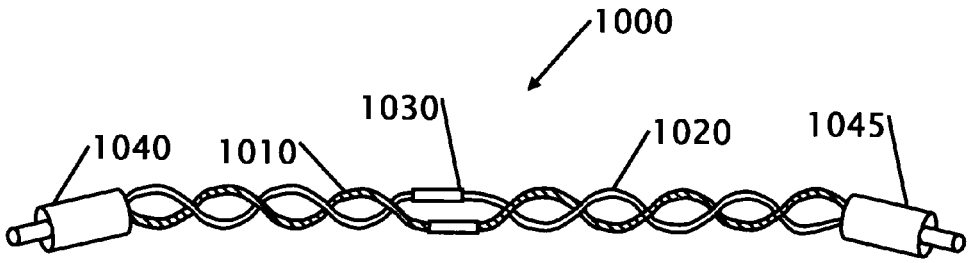
FIG. 10 is a constructional view of a interconnect cable for mixed frequency connection according to one embodiment.

Referring now to FIG. 10 that shows a constructional view of a interconnect cable for mixed frequency connection according to one embodiment. In this embodiment the cable 1000 is configured as an interconnect cable between high fidelity components such as CD player and preamplifier and between the preamplifier and the power amplifier. Because this connection can utilize a higher resistance conductor, the conductor is preferably nichrome wire jacketed with Teflon or similar insulator. The conductors 1010 and 1020 are twisted half way with a right hand twist and hand way with a left hand twist. In the middle of the cable the left and right hand twists are connected 1030. The left and right hand twists cancel out the signal that would be absorbed and transmitted by a cable with only a right or left twist. The cable ends are shown terminated with RCA plugs, but other termination connectors can include but not be limited to standard RCA plugs or XLR plugs.

Figure 11:
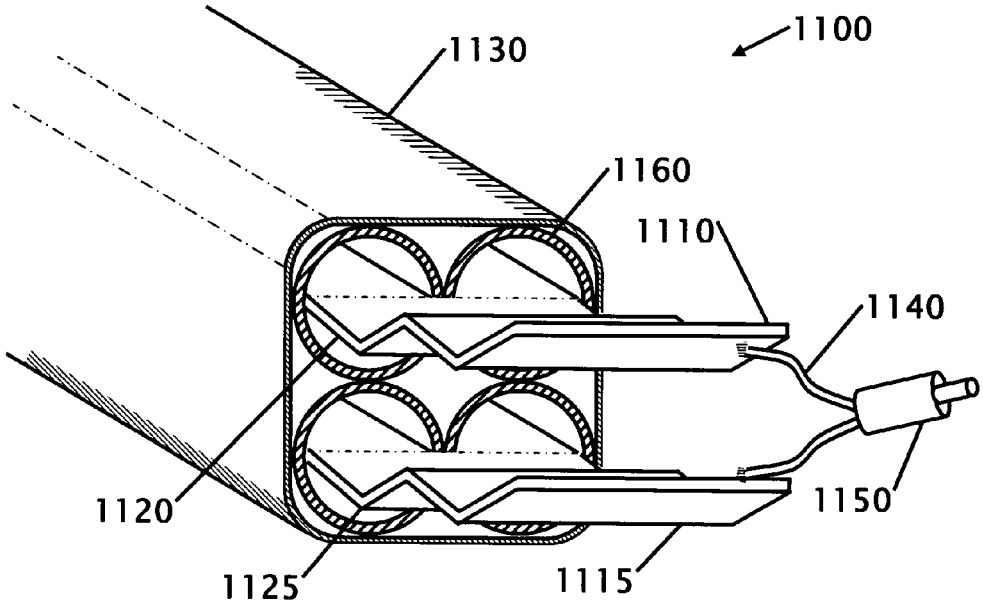
FIG. 11 is an alternate isometric view of an interconnection cable for mixed frequency connection according to a second embodiment.

Referring now to FIG. 11 that shown an alternate isometric view of an interconnection cable for mixed frequency connection according to a second embodiment 1100. In this embodiment the capacitance that is present from one conductor to another is minimized because the conductors are insulated using a split tube 1160 that maintains the conductors in a relationship that keeps an air gap between the conductors. Because the tube holds the cables in a spaced orientation the conductors can be made larger to reduce their resistance and increase their surface area to give greater skin surface area. The conductors 1120 and 1125 are preferably made from ribbons of nichrome, but could be made from any of the aforementioned conductive materials. The conductors are slid in the slots of the split tubing 1160 where they are maintained in physical relationship with each other. The ends 1110 of the strips are corrugated 1115 to allow them to flew as they are terminated with wire 1140 and the wire is then terminated with a connector such as a RCA jack 1150. The two sets of split tubes 1160 are placed with in a holder or jacket 1130 that maintains the tubes as a single unit.

Figure 12:
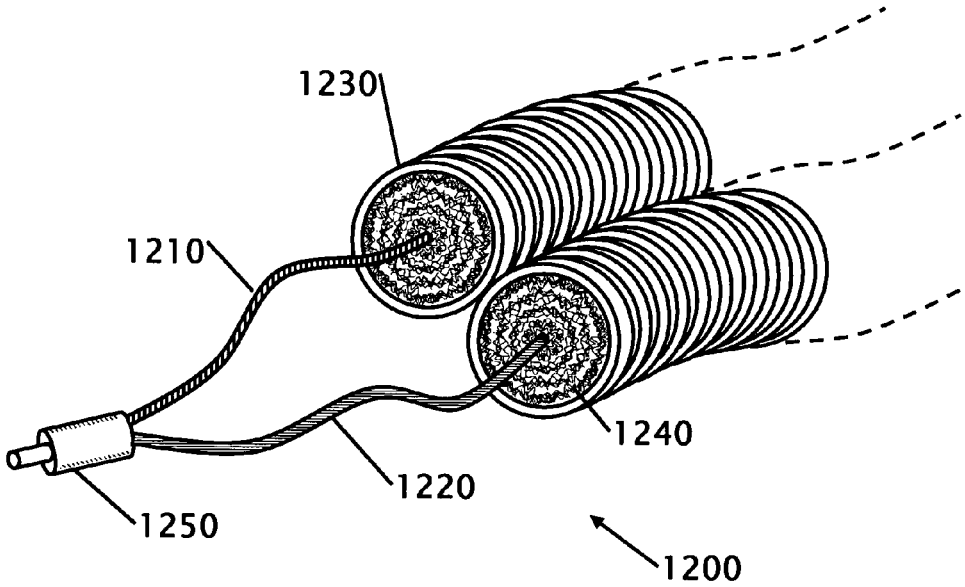
FIG. 12 is an alternate isometric view of a cable using metallic fibers as conductors.

FIG. 12 is an alternate isometric view of a cable using metallic fibers as conductors 1200. In this embodiment the invention employs the implementation of steel wool 1240, or an appropriate analog of steel wool, as the conductive medium in the interconnect application. In the loudspeaker cable application a substrate of steel wool or a steel wool analog would serve as a substrate disposed beneath other conductors in the composite laminate, said other conductors comprising typically copper, lead, tungsten, or a tungsten-copper alloy. The metallic fibers 1240 are jacketed in insulating tubes 1230. Wire conductors 1210 and 1220 connect the metallic fibers to a terminator such as an RCA jack 1250.

An analog of steel wool may be Nichrome wool. Nichrome wool would be fabricated on the same or similar machinery used to manufacture steel wool from steel metal stock billets.

Steel wool as a conductor in the present invention embraces the selfsame inherent DC resistance germane to, and a key feature of, the present invention, in that the DC resistance of the steel wool conductor swamps the inherent inductive reactance of the selfsame conductor at the pertinent audio frequencies addressed by the invention.

Moreover, the use of steel wool presents the following advantage: Steel wool enclosed in an insulating tube represents a large diameter conductor with what is essentially great porosity; The thousands of fine steel, or, alternatively, Nichrome, fibers each carry the audio signal through the length of the tube but in a random fashion not unlike the phenomenon observed in Litz wire, notwithstanding the fact that the individual steel fibers are not individually insulated from one another. In the case of steel wool the electromagnetic field of the signal is statistically randomized as the current courses through the thousands of random, homogeneous pathways afforded by the steel wool fibers. The result is a totally randomized and therefore statistically accurate transfer of the signal from source to load, yielding highly faithful reproduction of the audio signal at the load.

Figure 13:
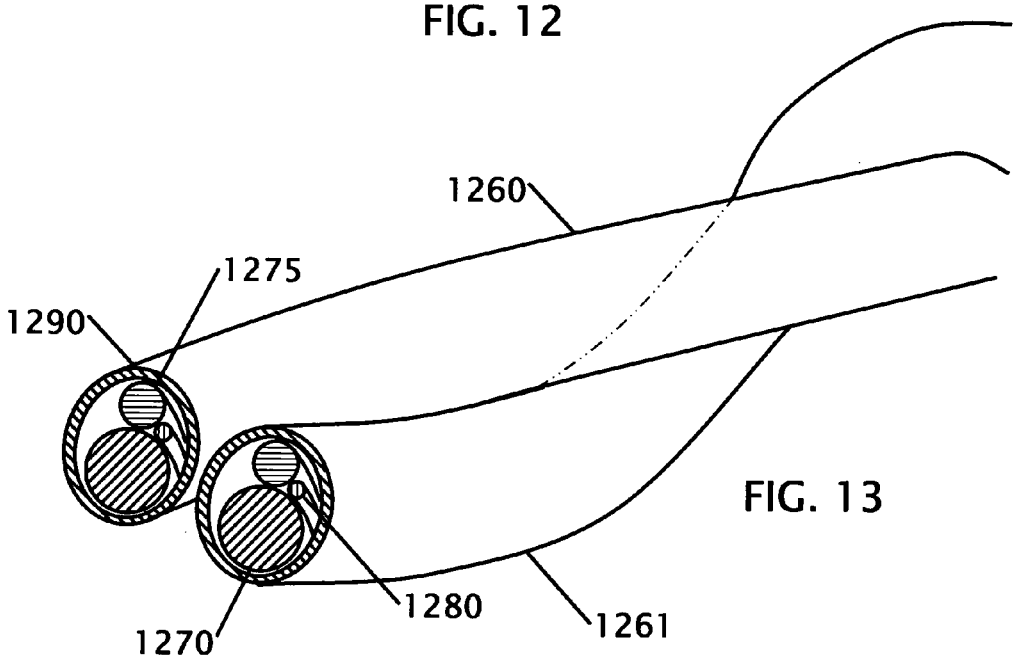
FIG. 13 shows a sectioned isometric view of twisted pair conductors using multiple conductors having different conductivity.

FIG. 13 shows a sectioned isometric view of twisted pair conductors using multiple conductors having different conductivity. The pair of conductors 1260 and 1261 is made from a combination of individual wires 1270. 1275 and 1280. Each set of wires is enclosed in an insulating tube 1290 that extends around and between each of the conductors. In the embodiment shown three conductors of different diameters are shown but as few as two the many more than three conductors are contemplated. The diameter of each conductor is different to correspond to the different conductivity of each wire. In one contemplated embodiment a wire that the five times more resistive would be five times greater in cross sectional area. In another contemplated embodiment the diameters of each wire is varied based upon the depth of the skin effect. The wires are twisted to provide electrical contact of the individual wires along the length of the conductor. It should be noted that the conductors are twisted along their length. This twisting can be the same along the entire length of the conductors or varied as shown and described in FIG. 10.

Figure 14:
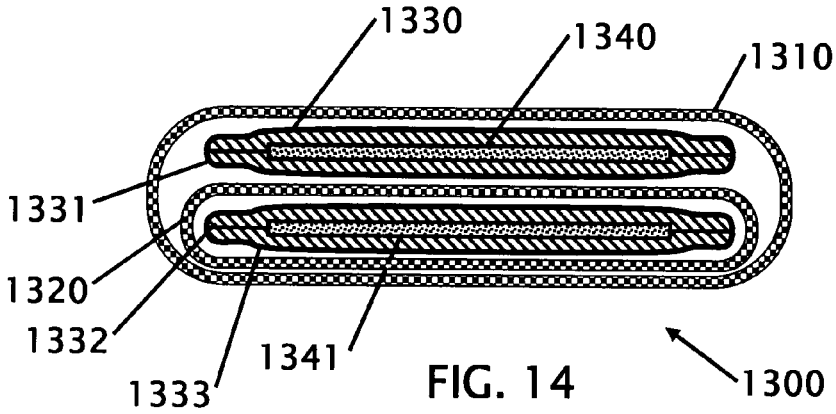
FIG. 14 shows a cross section of a preferred embodiment of speaker cable.
Figure 15:
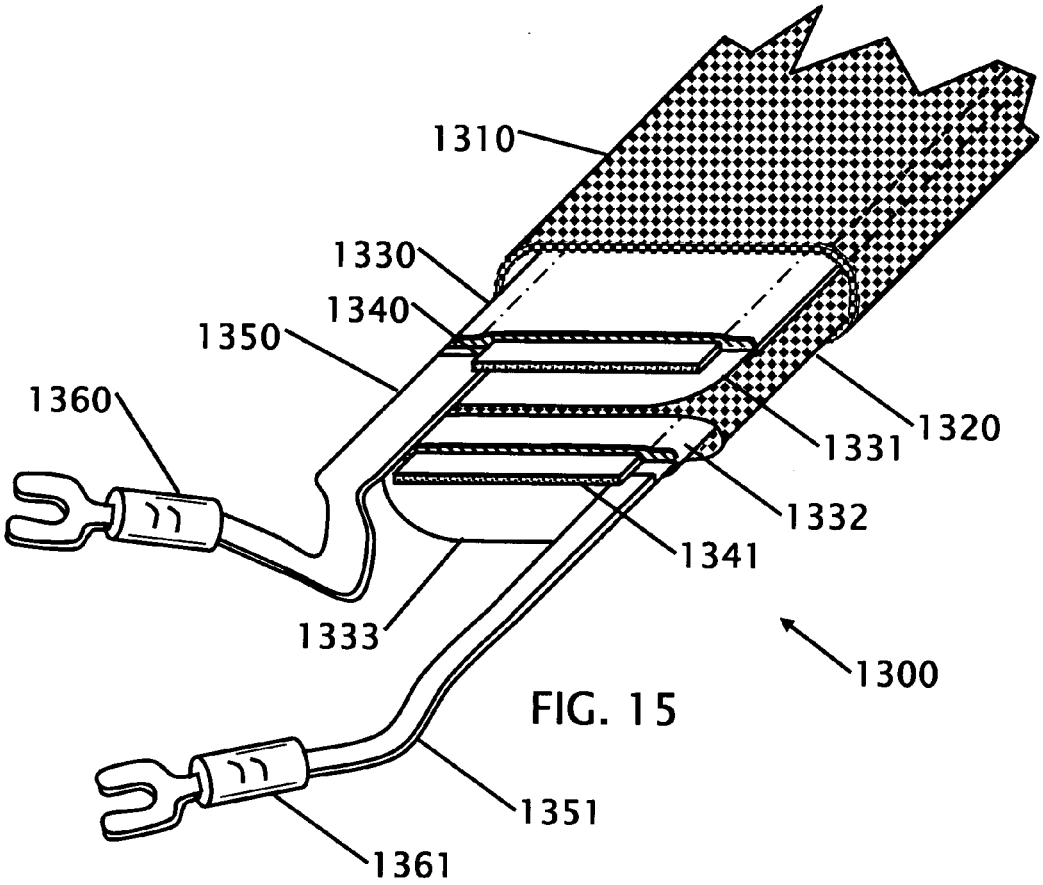
FIG. 15 shows the cable from FIG. 13 being terminated.

FIG. 14 shows a cross section of a preferred embodiment of speaker cable 1300 and FIG. 15 shows the cable from FIG. 14 being terminated. In this embodiment a copper cores 1340 and 1341 are covered by highly resistive conductor pairs 1330, 1331 1332 and 1333 respectively. One set of the conductors is sleeved in an inner flexweave jacket 1320 to provide insulation from the other conductor. Both conductors and the inner flexweave jacket are then placed in an outer flexweave jacket 1310. FIG. 15 shows the termination of the flat conductor where braded pigtails 1350 and 1351 are soldered or bonded to the conductors. It should be noted that the braded pigtails connect to both the copper core 1341 or 1340 and the highly resistive conductors. It should also be noted that the braded pigtails are connected to the conductors on opposite sides of the flat conductors to minimize direct or accidental contact with each other. While the braded pigtails are shown on opposite side of the flat cable they could also be constructed connecting to the flat conductors in the middle of the flat conductors.

Figure 16:
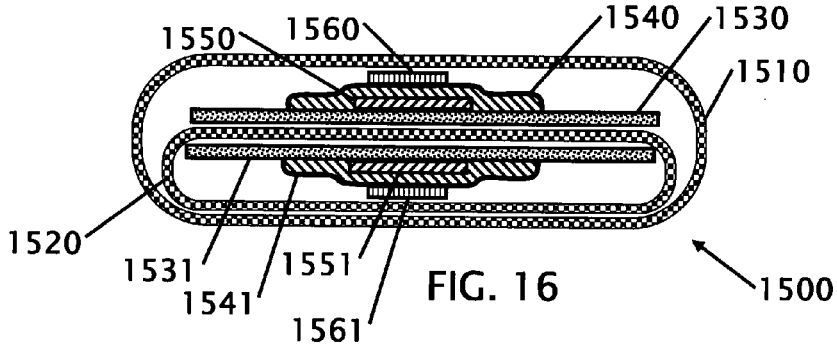
FIG. 16 shows a cross section of a preferred embodiment of an interconnect cable.
Figure 17:
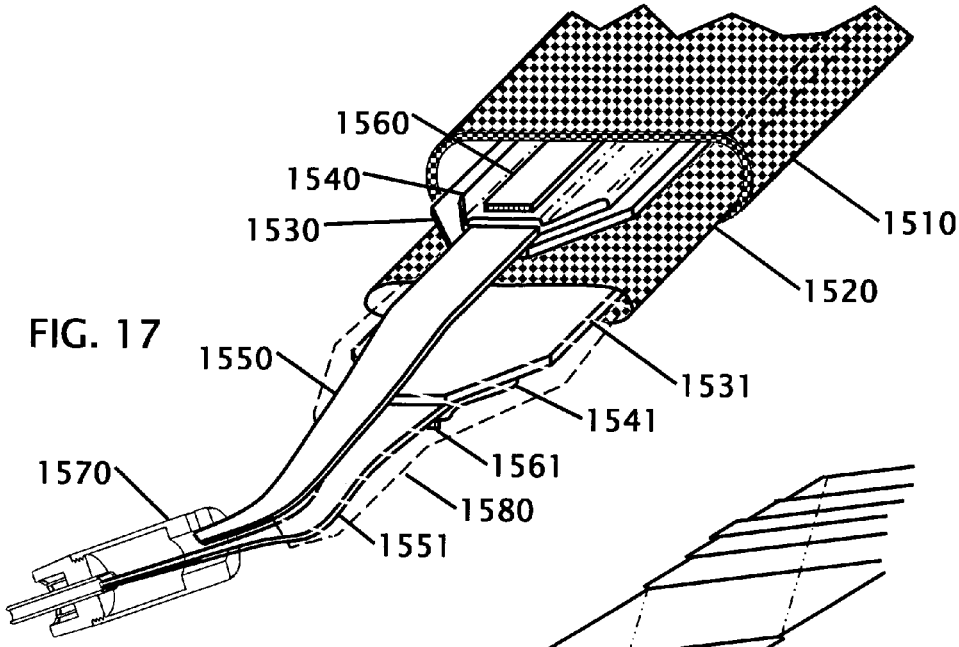
FIG. 17 shows the cable from FIG. 15 being terminated.

FIG. 16 shows a cross section of a preferred embodiment of an interconnect cable 1500 and FIG. 17 shows the cable from FIG. 16 being terminated. The overall cable construction form this configuration is similar to the cable construction shown and described in FIGS. 14 and 15. The difference is that the conductors are made with a larger number of different materials each having a different resistivity. The cables are also constructed in a mirror image arrangement that is best shown in FIG. 16. The conductive strips are bonded to each other using conductive adhesives. In the construction shown the bottom members 1530 and 1531 are nichrome. The next conductor 1550 and 1551 are made from stainless steel. An aluminum conductor 1540 and 1541 are used next with a conductor of copper 1560 and 1561 over the top of the conductor. In one contemplated embodiment the cross sectional are each different metal conductor is different to correspond to the different conductivity of each metal conductor. As an example a conductor that is five times more resistive would be five times greater in cross sectional area. In another contemplated embodiment the cross sectional area of each different metal is varied based upon the depth of the skin effect.

An insulator 1580 is shown placed between the two conductors where the conductors are terminated with the connector 1570. While a RCA type jack is shown various other types of connectors are contemplated.

Figure 18:
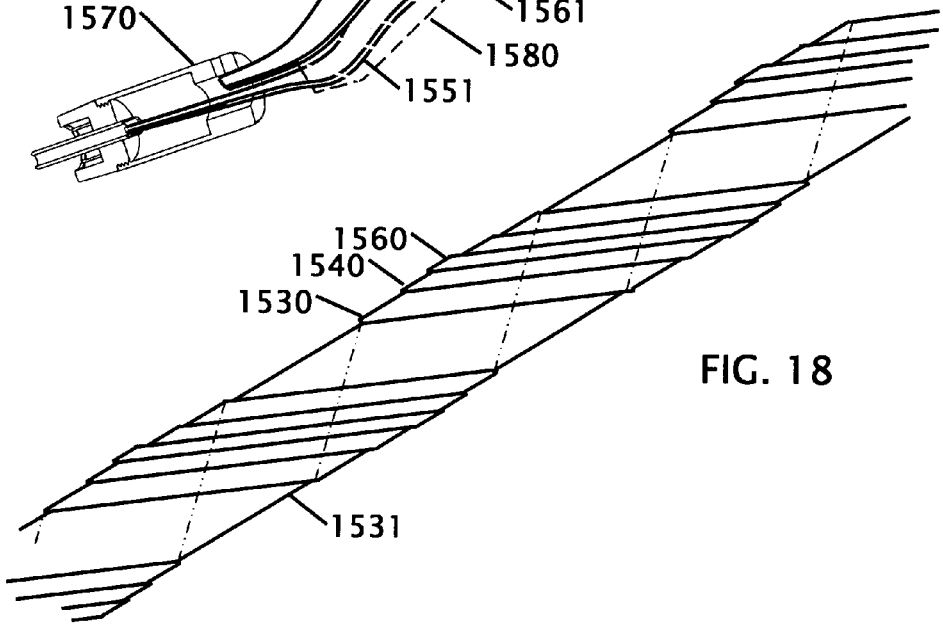
FIG. 18 shows an embodiment of the ribbon cable with one conduction wrapping around another conductor.

FIG. 18 shows an embodiment of the ribbon cable with one conduction wrapping around another conductor. As shown in this FIG., one conductor consisting of metals 1530, 1540 and 1560 are shown wrapping around the other conductor 1531. A dielectric is placed between the separate conductors to eliminate shorting of the conductors. It is further contemplated that the first conductor could be wrapped around the second conductor along half the length of the cable, and then the second conductor would be wrapped around the first conductor for the other half of the cable length to equalize the overall length of each conductor.

Thus, specific embodiments of an electrical cable employing resistance conductors have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A cable made of paired conductors for minimizing frequency sensitive group delay each paired conductor comprising:

a sandwich made of laminated flat conductors each having different conductive properties wherein the cross sectional area of each laminated conductor is varied to inversely correspond to the conductive properties of each laminated conductor;

said laminated conductors are bonded using a conductive bonding adhesive agent and further includes a first compliant insulator placed around a first paired conductor and a second compliant insulator placed around the first paired conductor, second paired conductor and the first compliant insulator.

2. The cable made of paired conductors for minimizing frequency sensitive group delay from claim 1 wherein the laminated conductors consist of a combination of conductors including at least two of nichrome, aluminum, copper, silver, gold, lead, zinc, carbon, copper-tungsten alloys, palladium, stainless steel, tungsten and platinum.

3. The cable made of paired conductors for minimizing frequency sensitive group delay from claim 1 wherein the thickness of each laminated conductor is varied based upon the skin effect forces of each laminated conductive material.

4. The cable made of paired conductors for minimizing frequency sensitive group delay from claim 1 wherein at least one of the paired conductors includes a structural member to reduce damage to the conductors from bending and stretching.

5. The cable made of paired conductors for minimizing frequency sensitive group delay from claim 1 wherein the combination of laminated flat conductors are constructed to optimize audio transmission from 20 to 20,000 Hz.

6. The cable made of paired conductors for minimizing frequency sensitive group delay from claim 1 wherein said sandwich of each of laminated flat conductors is oriented in said first and said second compliant insulators in an orientation where the width of each said sandwich is placed on top of each other.

7. The cable made of paired conductors for minimizing frequency sensitive group delay from claim 1 that further includes RCA termination jacks on each end of said cable.

8. The cable made of paired conductors for minimizing frequency sensitive group delay from claim 1 that further includes spade lugs on each end of each said laminated conductor.

* * * * *